United States Patent [19]

Turner

[11] Patent Number: 4,681,257

[45] Date of Patent: Jul. 21, 1987

[54] HOT-WATER-FURNACE SUPPLEMENTAL HEATER

[76] Inventor: Reginald R. Turner, 1400 Kilmer Ln., Norfolk, Va. 23502

[21] Appl. No.: 895,638

[22] Filed: Aug. 12, 1986

[51] Int. Cl.[4] ..... F24D 3/00

[52] U.S. Cl. ..... 237/56; 237/19; 122/20 B

[58] Field of Search ..... 237/53, 19, 8 R, 56; 122/20 B; 126/362

[56] References Cited

U.S. PATENT DOCUMENTS

| | | | |
|---|---|---|---|
| 4,438,728 | 3/1984 | Fracaro | 126/362 |
| 4,467,959 | 8/1984 | Laviguer | 237/55 |
| 4,484,564 | 11/1984 | Erickson | 126/365 |
| 4,485,746 | 12/1984 | Erlandsson | 110/234 |
| 4,512,288 | 4/1985 | Michaud | 122/20 |
| 4,531,509 | 7/1985 | Wilhelm | 126/362 |
| 4,557,202 | 12/1985 | Warner | 110/216 |
| 4,557,220 | 12/1985 | Jannemann et al. | 122/20 |

FOREIGN PATENT DOCUMENTS

| | | | |
|---|---|---|---|
| 1368502 | 6/1964 | France | 237/19 |

OTHER PUBLICATIONS

Burmham American Specification Sheet, 3 pages.
Columbia Specification Sheet, TE Series, 4 pages.

*Primary Examiner*—Henry A. Bennet
*Attorney, Agent, or Firm*—Griffin, Branigan & Butler

[57] ABSTRACT

A hot-water-furnace supplemental heater (60) replaces a manifold (48) used with a normal hot-water-furnace (10) having multiple furnace heating tubes (22). The supplemental water heater has a housing with a false bottom (66) and a supplemental tube (67) extending between a false bottom opening and a top-wall opening of the housing. A sidewall (62) of the housing and the false bottom form a manifold cavity (72) which collects combustion materials exiting from top ends (52) of the furnace heating tubes and directs them into the supplemental heating tube for heating water in a supplemental water heater cavity (68) defined by the sidewall, the false bottom, a top wall (64) and the supplemental heating tube. In a system, the supplemental water heater is placed in series with a furnace water heater to preheat water passing into the furnace water heater.

10 Claims, 4 Drawing Figures

HOT-WATER-FURNACE SUPPLEMENTAL HEATER

BACKGROUND OF THE INVENTION

This invention relates generally to the art of hot-water house furnaces (furnaces using hot-water radiators for heat distribution) and more particularly to a device for increasing the water capacities of such furnaces and for making such furnaces more efficient.

A number of U.S. patents have been obtained for devices which capture waste heat from furnaces in order to increase efficiency, some of which are U.S. Pat. No. 4,467,959 to Laviguer, U.S. Pat. No. 4,484,564 to Erickson, U.S. Pat. No. 4,485,746 to Erlandsson, U.S. Pat. No. 4,512,288 to Michaud, U.S. Pat. No. 4,557,202 to Warner, and U.S. Pat. No. 4,557,220 to Jannemann et al. However, in most of these cases the structures for obtaining such increased efficiency are quite difficult to add to exisiting systems, many of which require special supporting frameworks and furnace modifications in order to provide sufficient space and support therefor. Thus, it is an object of this invention to provide a hot-water-furnace supplemental water heater which captures waste heat but which also is easy to install and requires relatively little modification of an existing water-heating-furnace system.

In addition, most prior art devices for capturing waste heat from furnaces require special, expensive, heat exchangers. It is therefore another object of this invention to provide a device for capturing waste heat which does not involve the use of special expensive, or delicate, heat exchangers.

Still another shortcoming of some prior art waste-heat-capturing systems is that they often do not increase the water capacity of a hot-water furnace system. It is an object of this invention to provide a supplemental water heater, a system for the supplemental water heater's use, and a method for using the supplemental water heater which increases the quantity of water for holding more heat at a lower temperature than is otherwise possible.

SUMMARY

According to principles of this invention, a supplemental water heater rests on top of a water-heater furnace to replace a furnace manifold which ordinarily collects combustion materials exiting from top ends of furnace heating tubes. The supplemental water heater has a false, or raised, bottom so that a bottom portion thereof forms a manifold cavity which collects combustion materials exiting from the top ends of the furnace heating tubes and directs it through a supplemental heating tube which is surrounded by water in a supplemental water heating cavity. The supplemental water heating cavity is coupled in series with a furnace water heating cavity to effectively increase the amount of water available to store heat for a house radiator system.

BRIEF DESCRIPTION OF THE DRAWINGS

The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
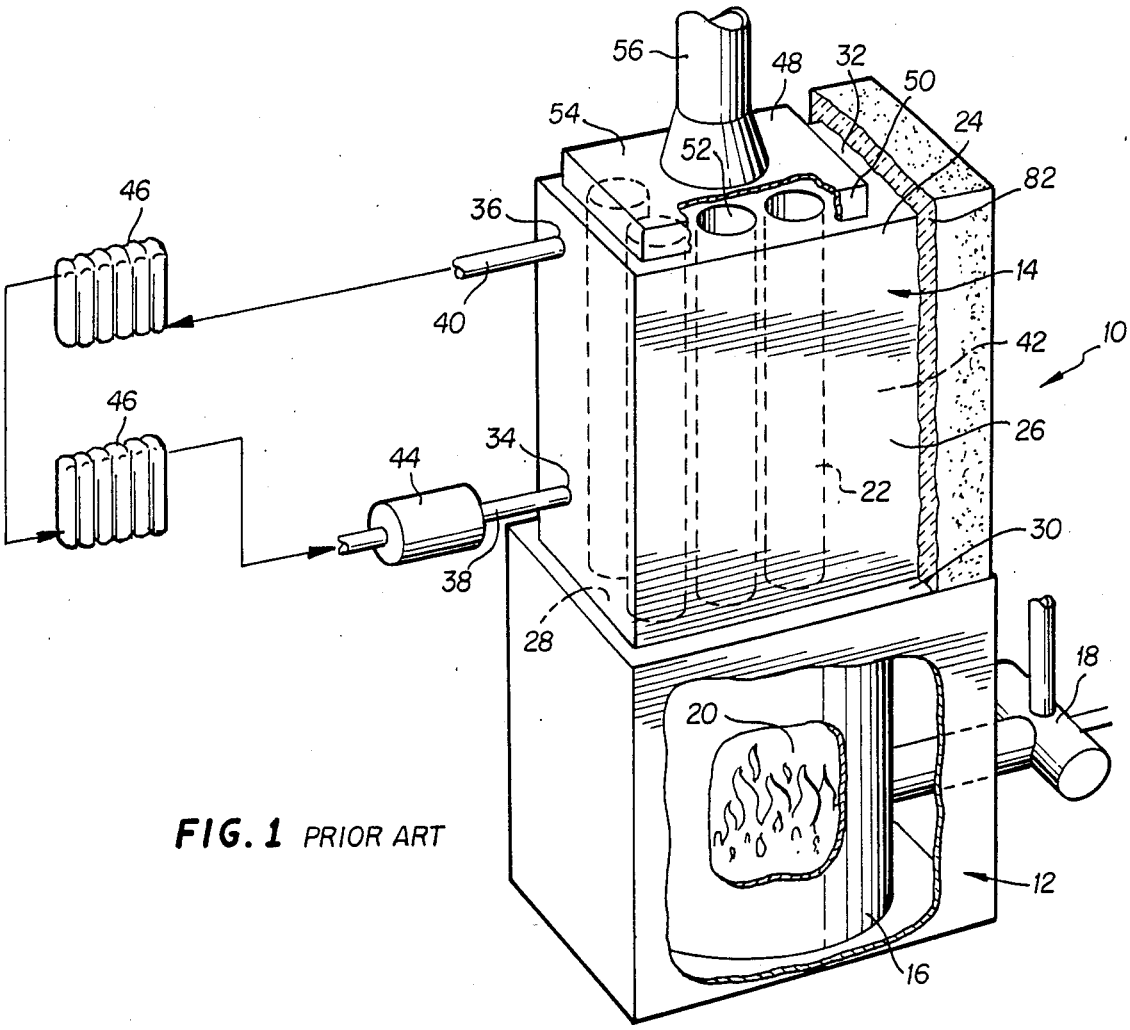
FIG. 1 PRIOR ART
FIG. 1 is a prior art, partially schematic, isometric view of a hot-water house-heating furnace system, including a circulation system, of the type with which this invention is used.

A hot-water house-radiator furnace 10 comprises generally a firebox section 12 and a hot water section 14.

The firebox section 12 includes a firebox 16 which is fed fuel and air by an oil or gas fired burner 18. The burner 18 causes combustion in a combustion chamber 20 and combustion materials therefrom rise through vertically oriented, parallel, furnace heating tubes 22 in the hot water section 14.

The hot water section 14 basically comprises a furnace hot water housing 24 which has a sealed rectangularly-shaped hot water section sidewall 26. A bottom 28 thereof forms a top wall 30 of the firebox section 12 and a flat top wall 32 seals the top. Passages of the furnace heating tubes 22 communicate with openings in the respective firebox section top wall 30 and the hot water section top wall 32 to allow passage of combustion materials from the combustion chamber 20 out the tops of the furnace heating tubes 22. The hot water section sidewall 26 has an inlet 34 at the bottom thereof and an outlet 36 at the top thereof to which an inlet pipe 38 and outlet pipe 40 are respectively attached. A cavity 42 formed by the housing of the hot water section 14 surrounds the furnace heating tubes 22, thus, combustion materials passing through the furnace heating tubes 22 give off heat to walls of the furnace heating tubes 22 which heats water in the water heating cavity 42. When in operation, this water is circulated by a pump 44 via the inlet and outlet pipes 38 and 40 through radiatiors 46 in a house, to thereby heat the house.

Sealingly attached to the hot water section top wall 32, by means of screws or the like, is a rectangularly-shaped manifold 48 whose sidewall 50 encompasses all of ends 52 of the furnace heating tubes 22 and whose top wall 54 guides combustion materials exiting from top ends of the heating tubes 22 into and through a chimney pipe 56 which is sealingly attached to the top wall 54 of the manifold 48 at a hole (not shown) in the top wall 54.

In furnaces of the type depicted in FIG. 1 the manifold 48 is normally removable from the hot water section top wall 32 with little effort, sometimes involving the removal of screws or the like.

Figure 2:
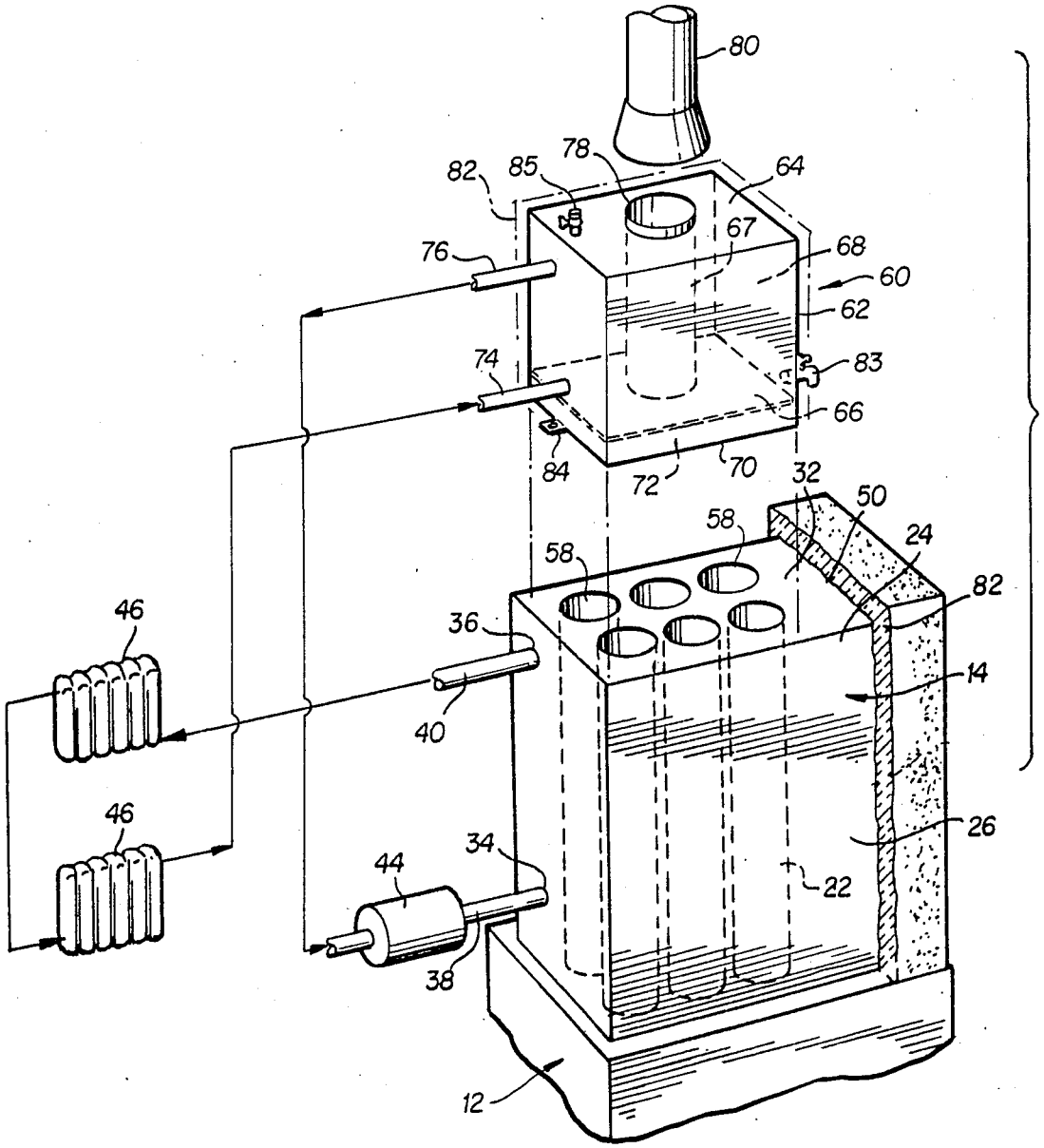
FIG. 2 is an exploded, partially schematic isometric view of the furnace system of FIG. 1 having a manifold thereof replaced by a supplemental water heater of this invention which is interconnected in the distribution system.

The device and method of this invention is depicted in FIG. 2 wherein are included the firebox section 12 and the hot-water section 14 of the prior-art furnace of FIG. 1. In the exploded view of FIG. 2, the upper ends 52 of the furnace heating tubes 22 are shown extending through holes 58 in the hot water section top wall 32 although all furnaces are not like this. The manifold 48 is no longer used in the FIG. 2 embodiment. Instead, the manifold 48 and a section of the chimney pipe 56 are replaced by a supplemental water heater 60 of this invention. The supplemental water heater 60 has a sidewall 62, a top wall 64, a false bottom wall 66, and a supplemental heating tube 67 extending between the top wall 64 and the false bottom wall 66.

The sidewall 62, top wall 64 and the false bottom wall 66 form a sealed supplemental heater cavity 68 for holding heating water. As can be seen in FIG. 2, the false bottom 66 is raised approximately 1 and 1/2 inches from a planar bottom edge 70 of the sidewall 62 so as to form a manifold cavity 72 enclosed by the bottom side of the false bottom wall 66 and the inside surfaces of the sidewall 62 below the false bottom wall 66. A supplemental water heater inlet pipe 74 and a supplemental water heater outlet pipe 76 communicate with the supplemental water heater cavity 68 by holes in the sidewall 62, with the inlet pipe 74 being connected close to the bottom of the cavity 68 and the outlet pipe 76 being connected close to the top of the cavity 68. The supplemental heating tube 67 communicates via a hole in the false bottom wall 66 with the manifold cavity 72 and extends through a hole in the top wall 64 so that a chimeny-connection portion 78 protrudes slightly above the top wall 64. The supplemental water heater cavity is sealed so as to hold heated water about the supplemental heating tube 67. The supplemental water heater outlet pipe 76 is connected in series with the pump 44 and the supplemental water heater inlet pipe 74 is connected in series with the radiators 46. The other end of the radiator circuit is still connected to the outlet 40 of the hot water section 14.

A chimney pipe 80 is attached to the chimney-connection portion 78 of the supplemental heating tube 67.

In the preferred embodiment, the supplemental water heater 60 and the hot water section 14 are surrounded by insulation 82, which is only partially shown in FIGS. 1 and 2 for purposes of simplicity. The bottom of an insulation jacket for the supplemental water heater 60 can rest on the hot-water-section top wall 32. The insulation jacket could have a thin metal cover, if desired, to be uniform in size with an existing metal insulation cover of the hot water section 14.

In one embodiment, the fire box section 12 and the hot water section 14 of the furnace 10 stand about 46 inches in height, however, there are all different sizes of such furnaces available. The hot water section 14 holds 12 gallons of water while the supplemental water heater 60 holds 16 gallons of water. The sidewall 62, top wall 64 and false bottom wall 66 of the supplemental water heater 60 are constructed of five pound plate steel, 1/8 inch thick. The edges of the respective plates are welded together and to the supplemental heating tube to be be water-tight. In one embodiment, the portion of the sidewall 62 extending below the false bottom wall 66 is separate from the sidewall 62 above the false bottom wall 66, however, in another embodiment, these members are integral. In the case where the portion of the sidewall 62 below the false bottom wall 66 is separate, this portion need not have the same peripheral size as the sidewall above the false bottom, but rather can be attached directly to the false bottom wall 66 to be smaller or larger than the rest of the sidewall. The sidewall 62 is approximately 24 inches high and the top wall 64 has dimensions of 11 inches by 17 inches. In many furnaces there are eight three inch furnace heating tubes 22.

A drain 83 allows one to selectively drain the supplemental water heater 60 when necessary.

An air bleed valve 85 is also included for bleeding air from the top of the supplemental water heater so that it can be completely filled with water.

Further pressure relief valves and other safety valves should not be necessary because the hot water section 14 has such built-in safety features (not shown) and the supplemental water heater 60 is in communication with it. However, it should be understood that such safety valves can also be added directly to the supplemental water heater 60, where desired.

In use of the supplemental water heater, an existing hot-water, house-radiator furnace 10 is modified by removing the manifold 48 and a portion of the chimney pipe 56 immediately adjacent thereto from the hot water section top wall 32. The manifold 48 and the section of the chimney pipe 56 are replaced by the supplemental water heater 60 which can be attached to the hot water section top wall 32 in the same manner as the manifold 48 was attached. In this respect, the manifold 48 is sometimes attached with screws, thus, the depicted supplemental water heater 60 has screw tabs 84 (only one shown for simplicity) which allow it to be attached to the hot water section top wall 32. However, in the preferred embodiment the supplemental water heater 60 is simply held onto the hot water section top wall 32 by its weight, with no further attachment being necessary. It is understood that any gaskets necessary for appropriate sealing and proper operation of this invention can be included although gaskets are not usually necessary, and none are shown in the drawings.

A shortened chimney 80 is then attached to the chimney-connection portion 78 extending above the top wall 64. Also, an inlet to the pump 44 is detached from the radiator circuit 46 and is now attached to the supplemental water heater outlet pipe 76 while the radiator system connection which was attached to the pump 44 is attached to the supplemental water heater inlet pipe 74. Thus, water fed into the water-heating cavity 42 of the hot water section 14 is first sucked through the supplemental water heater cavity 68 of the supplemental water heater 60 by the pump 44.

The burner 18 is "fired up", thereby causing combustion in a combustion chamber 20 and causing combustion materials to pass through the furnace heating tubes 22 up into the manifold cavity 72 against the bottom surface of the false bottom wall 66. These combustion materials are directed through the supplemental heating tube 67 out through the shortened chimney pipe 80. While making this trip the combustion materials heat water in the furnace water heating cavity 42 and water in the supplemental water heater cavity 68 before being exhausted through the chimney pipe 80. This water is circulated by the pump 44 in series through the supplemental water heater cavity 68, the furnace water-heating cavity 42, the radiator system 46 and back to the supplemental water heater cavity 68.

Figure 3:
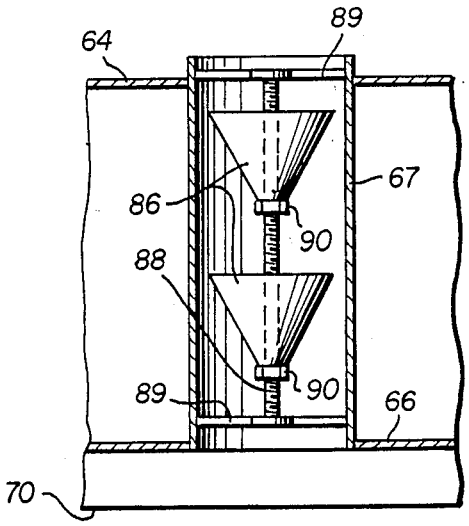
FIG. 3 is a side cutaway view of a modified embodiment of the supplemental water-heating tube of the FIG. 2 embodiment; and, FIG. 4 is an end view of the supplemental water heating tube of FIG. 3.
Figure 4:
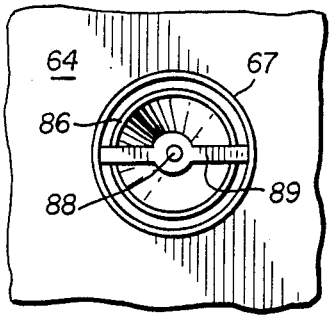

A refinement of this invention is depicted in FIGS. 3 and 4. Funnel-shaped baffles 86 are mounted on a centrally positioned rod 88 in the supplemental water-heating tube 67 for directing combustion gasses outwardly against the wall of the tube 67. This improves the efficiency of heat exchange to the wall. The rod 86 is mounted on diameter cross bars 89 located at opposite ends of the supplemental heating tube 67. The rod 88 is threaded, with huts 90 being engaged therewith for mounting the baffles 86.

It will be understood by those skilled in the art that the supplemental water heater 60 has a convenient and useful place of support since it replaces a part which exists on many hot-water, house-radiator furnaces. Also the design of the supplemental water heater is particularly efficient with its false bottom wall 66 receiving combustion-material "blasts" from upper ends 52 of furnace heating tubes 22. Thus, the supplemental water heater forms a water retainer and a heat exchanger. The supplemental water heater 60 more than doubles the water capacity of many hot-water, home-radiator furnace systems so that more water is available for storing heat. Thus, the same amount of heat can be stored at a lower temperature than is otherwise possible, which improves efficiency. The supplemental water heater 60 adds much flexibility to the use and installation of hot-water, house-radiator, furnace systems in that, fot example, when one is installed a homeowner can decide whether he wants a greater or lesser capacity, which would depend on the amount of money he wants to spend and/or the space he has for his furnace. Use of the supplemental water heater of this invention requires little or no modification to many existing hot-water, house-radiator furnace systems since it replaces an exisiting part thereof.

The present invention utilizes otherwise wasted heat and decreases the amount of time an existing furnace normally runs. It heats supplemental water above an existing furnace hot-water boiler with heat that, under normal conditions, would have escaped through the chimney. As a thermostat (not shown) of the existing furnace 10 calls for heat, warm water from the supplemental heater cavity 68 flows into the furnace hot water section 14 and cold return water from the house's radiators flows into the supplemental heater cavity 68. The already warm water flowing into the hot water section 14 reduces recovery time. Thus, the system requires less energy to heat the water while making the system less expensive to operate and requiring no additional energy sources.

Tests runs with the device, system and method of this invention have indicated that the use of a supplemental water heater of this invention increases combustion efficiency of a furnace system more than 6%.

While the invention has been particularly shown and described with reference to a preferred embodiment, it will be understood by those skilled in the art that various changes in form and detail may be made therein without departing from the spirit and scope of the invention. For example, many heating-tube type furnace systems are somewhat different than that depicted in the drawings. Also, there are various possibilities for placement of the false bottom wall 66 in relation to the manifold cavity 72 and the supplemental water heater cavity 68.

The embodiments of the invention in which an exclusive property or privelege are claimed are defined as follows:

1. A hot-water-furnace, supplemental water heater to be used with a furnace of the type having essentially parallel, vertically-oriented, multiple heating tubes surrounded by water for conveying combustion materials from a firebox to an exit area adjacent said multiple heating tubes to thereby heat. said water, said hot-water furnace forming a flat support wall at said exit area, said supplemental water heater comprising:

a housing having a top wall and a sidewall but an essentially open bottom, a bottom edge of said sidewall defining an opening which is sufficiently large to encompass adjacent ends of said multiple furnace heating tubes and defining a planar shape for resting on said hot-water-furnace flat support wall to support said supplemental water heater and to form a seal with said flat support wall for containing combustion materials, said top wall having a top-wall opening therein;

a false-bottom wall substantially spaced from said bottom edge of said sidewall and being sealingly attached to said sidewall, said false-bottom wall having a false-bottom opening therein;

a supplemental heating tube extending between said false-bottom opening and said top-wall opening whose ends are respectively sealingly attached to said false-bottom wall and said top wall, whereby said housing, said false-bottom wall and said supplemental heating tube form a supplemental water heating cavity surrounding said supplemental heating tube, said supplemental heating tube having at its upper end a means for attaching a chimney thereto; and water inlet and outlet means communicating with said supplemental water heating cavity for respectively conveying water to and from said cavity;

whereby said supplemental water heater can be placed on a housing of a hot water furnace, replacing a furnace manifold, with said bottom edge of said sidewall sealing with said furnace housing and encompassing said adjacent ends of said multiple heating tubes so as to capture combustion materials exiting in a manifold space defined by said sidwall below said false-bottom wall, said false-bottom wall and said furnace housing and thereby directing said combustion materials into said supplemental heating tube for heating water in said supplemental water heating cavity.

2. A supplemental water heater as in claim 1, wherein are further included tubes for coupling said water inlet and outlet means to a radiator system and to a furnace hot water housing respectively.

3. A supplemental water heater as in claim 1, wherein said supplemental water heater has only a single supplemental heating tube.

4. A supplemental water heater as in claim 1, wherein said sidewall has a rectangular cross-sectional shape.

5. A supplemental water heater as in claim 1, wherein said sidewall below said false-bottom wall is constructed from a piece of material which was originally separate from the remainder of said sidewall.

6. A supplemental water heater as in claim 1, wherein said supplemental heating tube has baffles therein for directing combustion materials against its wall.

7. A heating system comprising:

a hot-water-furnace having a furnace hot water housing holding water with parallel multiple heating tubes surrounded by the water for conveying combustion materials from a firebox of the furnace to an exit area adjacent exit ends of said multiple heating tubes, said hot-water furnace forming a support wall at said exit area, said hot water housing having an inlet and an outlet for respectively conveying water to and from said furnace hot water housing;

a separate supplemental water heater mounted on said furnace hot water housing adjacent said exit ends of said heating tubes for collecting combustion material exiting from said heating tubes and directing said combustion material through a supplemental heating tube, said supplemental heating tube being surrounded by a supplemental housings forming a supplemental water heater cavity with an inlet and an outlet for conveying water to and from said supplemental water heater cavity, one of said inlet or outlet of said supplemental water heater being coupled to a radiator system, and the other of said inlet or outlet of said supplemental water heater being coupled to the respective outlet or inlet of said furnace hot water housing, the other of said outlet or inlet of said furnace hot water housing being coupled to another end of said radiator system, said supplemental housing having a bottom edge which is sufficiently large to encompass adjacent exit ends of said multiple furnace heating tubes at said exit area and defining a shape for resting on said hot-water furnace support wall to support said supplemental water heater and to form a seal with said support wall for containing combustion materials, said supplemental water heater including a false bottom wall substantially spaced from said bottom edge of said sidewall and being sealingly attached to said sidewall to form the bottom of said supplemental water-heater cavity and the top of a combustion-material collecting manifold, said false bottom having a hole therein to allow combustion material to flow through said supplemental heating tube.

8. A heating system as claimed in claim 7, wherein said supplemental water heater has only a single supplemental water heating tube.

9. A heating system as in claim 7, wherein said supplemental water heater housing has a rectangular cross-sectional shape.

10. A heating system as in claim 7, wherein said supplemental heating tube has baffles therein for directing combustion materials against its wall.

* * * * *